US011185113B2

(12) United States Patent
Perry-Jackson

(10) Patent No.: US 11,185,113 B2
(45) Date of Patent: Nov. 30, 2021

(54) SHAPING UNDERGARMENT DEVICE

(71) Applicant: Micikell Perry-Jackson, Austell, GA (US)

(72) Inventor: Micikell Perry-Jackson, Austell, GA (US)

( * ) Notice: Subject to any disclaimer, the term of this patent is extended or adjusted under 35 U.S.C. 154(b) by 68 days.

(21) Appl. No.: 16/582,360

(22) Filed: Sep. 25, 2019

(65) Prior Publication Data

US 2021/0084990 A1 Mar. 25, 2021

(51) Int. Cl.
*A41B 9/06* (2006.01)
*A41C 3/08* (2006.01)

(52) U.S. Cl.
CPC ..... *A41B 9/06* (2013.01); *A41C 3/08* (2013.01); *A41B 2400/38* (2013.01)

(58) Field of Classification Search
CPC ..... A41B 9/06; A41B 2400/38; A41C 1/14; A41C 3/14; A41C 3/08; A41C 3/142; A41C 3/10; A41C 1/00; A41C 1/08; A41D 13/0007; A41D 13/0017; A41D 31/185; A41D 2400/38; A41D 1/18; A61H 2201/1652; A61F 5/02; A61F 5/026; A61F 5/03
USPC ..... 2/120, 122
See application file for complete search history.

(56) References Cited

U.S. PATENT DOCUMENTS 351,345 A * 10/1886 Stone ..... A41C 1/00 450/143
2,621,328 A * 12/1952 Duchnofskey ..... A41C 3/142 450/53
5,537,690 A * 7/1996 Johnson ..... A41C 1/08 2/44
6,855,029 B2 * 2/2005 Rothman ..... A41C 3/04 450/36
7,435,155 B2 * 10/2008 Reinisch ..... A41C 3/0028 450/59
7,908,670 B2 * 3/2011 Semba ..... A63B 21/4025 2/69
D641,130 S 7/2011 Zarabi
8,721,388 B2 5/2014 Quaranta
8,827,764 B2 9/2014 Caruso
8,910,317 B2 * 12/2014 Decker ..... A41D 1/08 2/227
9,198,467 B2 12/2015 Gordon
9,867,400 B2 1/2018 Solano
2004/0133959 A1 * 7/2004 Horii ..... A41D 7/00 2/69
2005/0029418 A1 * 2/2005 Lee ..... A41D 27/28 248/214

(Continued)

*Primary Examiner* — Jameson D Collier
*Assistant Examiner* — Matthew R Marchewka

(57) ABSTRACT

A shaping undergarment device for supporting breasts and shaping a torso of a user includes a shirt that is configured to be donned by a user so that the shirt substantially covers a torso of the user. A first slat, a set of second slats, and a pair of third slats are coupled to an inner surface of the shirt. The first slat is positioned adjacent to a lower limit of breasts of the user. The set of second slats is adjacent to and configured to support a back of the user. Each third slat extends over a respective shoulder of the user and is coupled to and extends between a respective opposing end of the first slat and the set of second slats. The pair of third slats is configured to transfer load from the first slat to the set of second slats.

13 Claims, 4 Drawing Sheets

(56) References Cited

U.S. PATENT DOCUMENTS

| | | | | |
|---|---|---|---|---|
| 2011/0214216 | A1 | 9/2011 | Zarabi | |
| 2018/0116306 | A1 | 5/2018 | Andre | |
| 2018/0228220 | A1* | 8/2018 | Meyer | A41B 9/06 |
| 2018/0352874 | A1* | 12/2018 | Cahan | B32B 1/00 |

* cited by examiner

SHAPING UNDERGARMENT DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to undergarment devices and more particularly pertains to a new undergarment device for supporting breasts and shaping a torso of a user.

(2) Description of Related Art Including Information Disclosed Under 37 CFR 1.97 and 1.98

The prior art relates to undergarment devices.

BRIEF SUMMARY OF THE INVENTION

An embodiment of the disclosure meets the needs presented above by generally comprising a shirt that is configured to be donned by a user so that the shirt substantially covers a torso of the user. A first slat, a set of second slats, and a pair of third slats are coupled to an inner surface of the shirt. The first slat is positioned adjacent to a lower limit of breasts of the user. The set of second slats is adjacent to and configured to support a back of the user. Each third slat extends over a respective shoulder of the user and is coupled to and extends between a respective opposing end of the first slat and the set of second slats. The pair of third slats is configured to transfer load from the first slat to the set of second slats.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
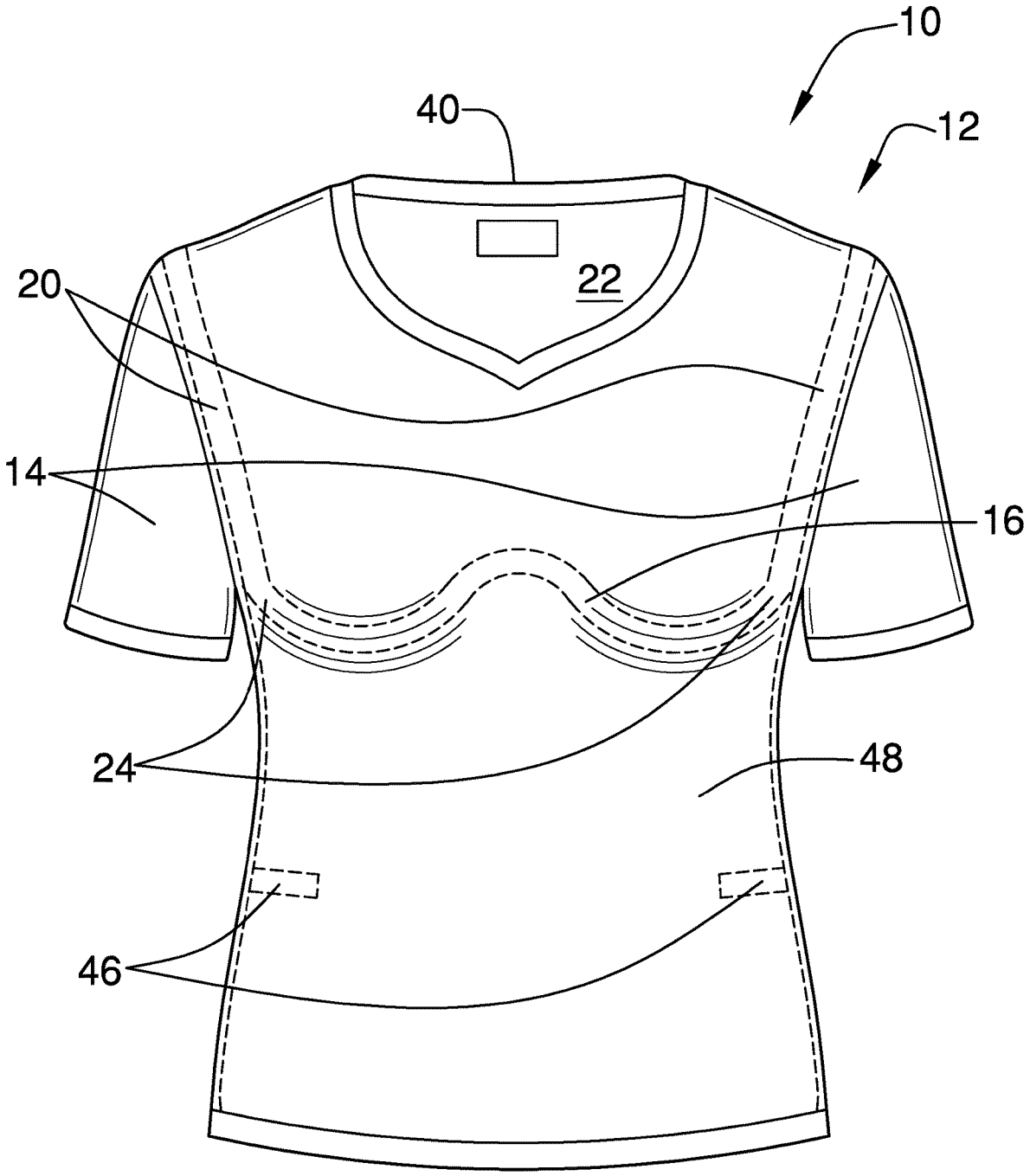
FIG. 1 is a front view of a shaping undergarment device according to an embodiment of the disclosure.

With reference now to the drawings, and in particular to FIGS. 1 through 4 thereof, a new undergarment device embodying the principles and concepts of an embodiment of the disclosure and generally designated by the reference numeral 10 will be described.

Figure 2:
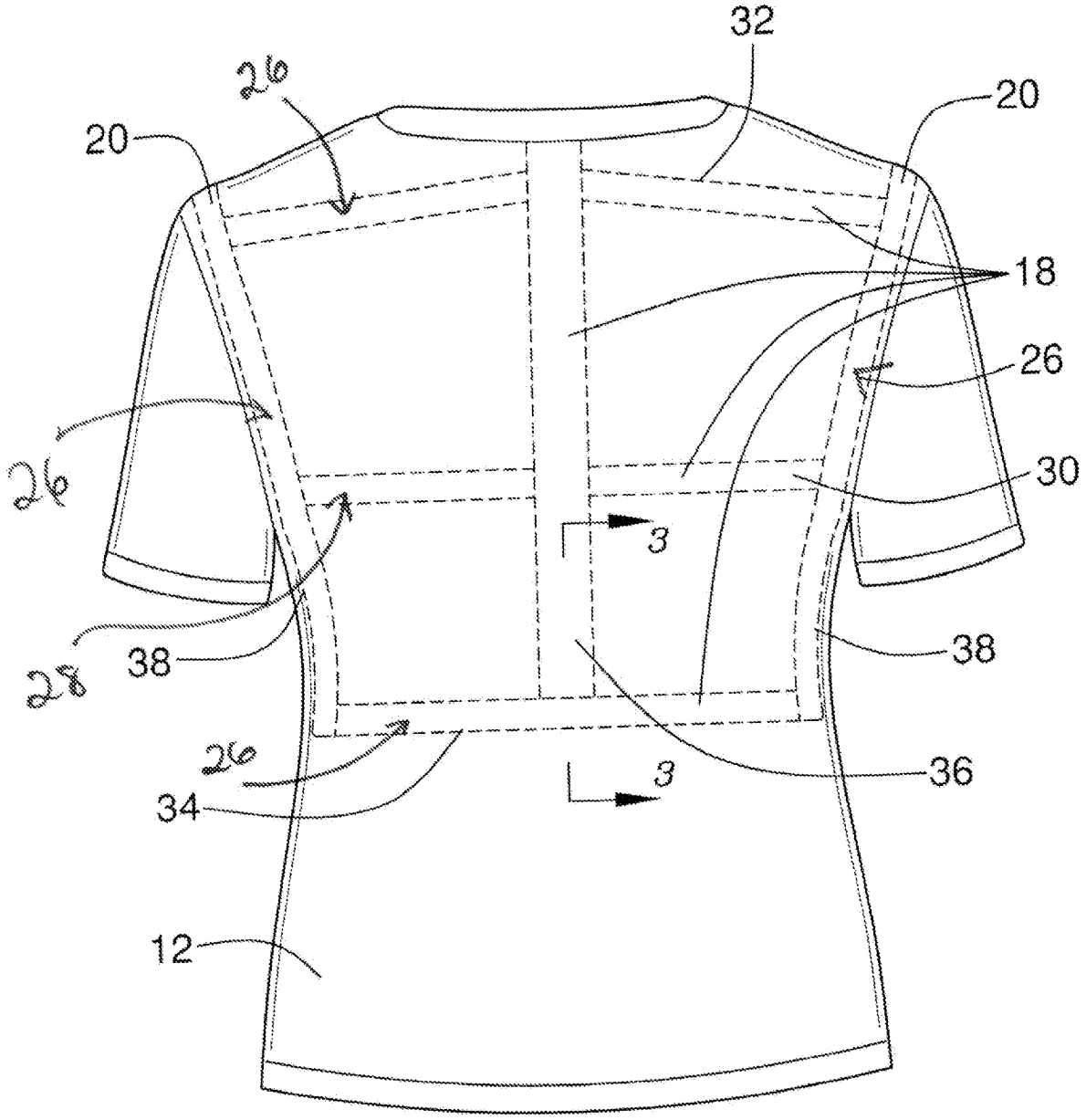
FIG. 2 is a rear view of an embodiment of the disclosure.
Figure 3:
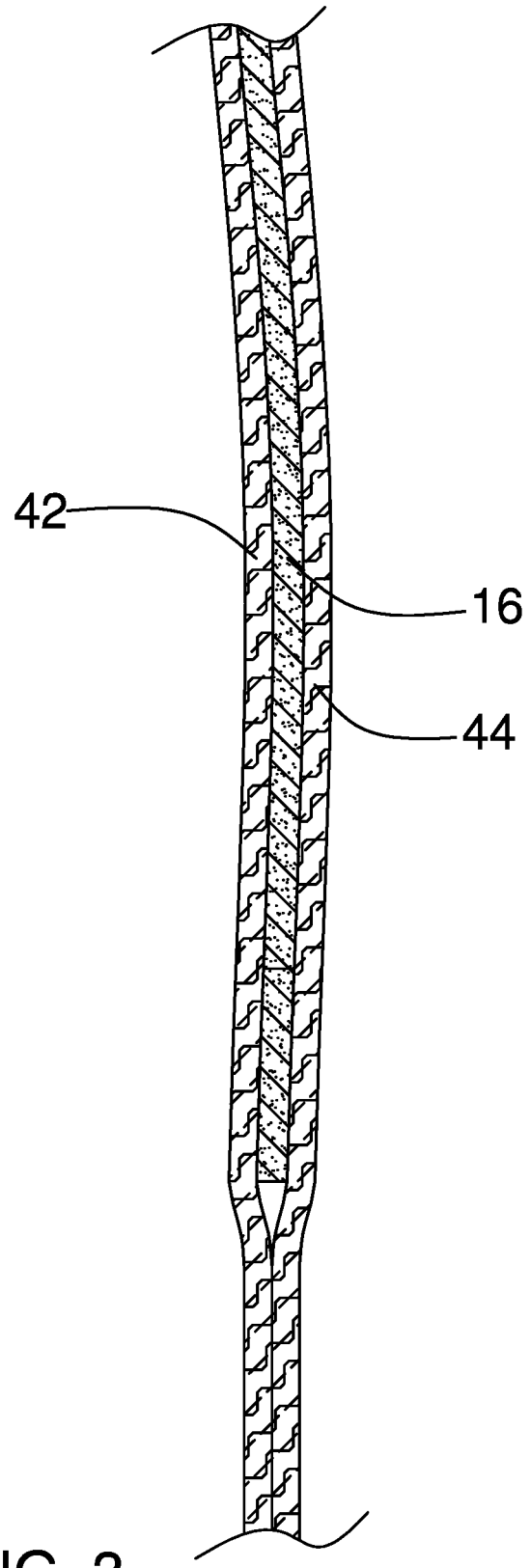
FIG. 3 is a cross-sectional view of an embodiment of the disclosure.
Figure 4:
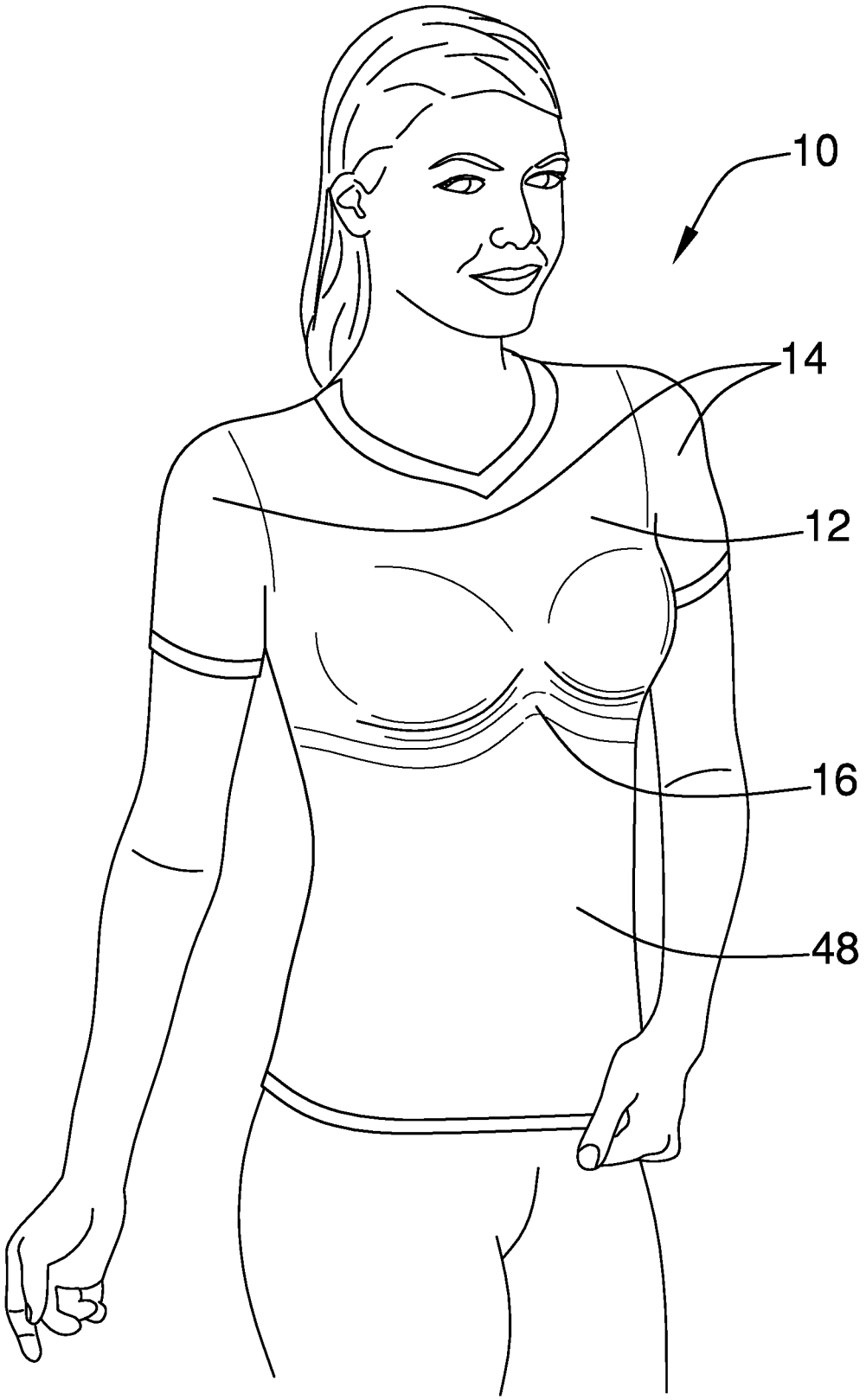
FIG. 4 is an in-use view of an embodiment of the disclosure.

As best illustrated in FIGS. 1 through 4, the shaping undergarment device 10 generally comprises a shirt 12 that is configured to be donned by a user so that the shirt 12 substantially covers a torso of the user. As shown in FIG. 4, the shirt 12 is resiliently stretchable so that the shirt 12 is form fitting. The shirt 12 may comprise polyether-polyurea copolymer, or other stretchable fabric, such as, but not limited to, polyester and the like. The shirt 12 may be short sleeved type so that sleeves 14 of the shirt 12 cover upper arms of the user. The sleeves 14 are configured to shape the upper arms of the user.

A first slat 16, a set of second slats 18, and a pair of third slats 20 are coupled to an inner surface 22 of the shirt 12. The first slat 16 is positioned adjacent to a lower limit of breasts of the user, as shown in FIG. 1. The set of second slats 18 is adjacent to and configured to support a back of the user, as shown in FIG. 2. Each third slat 20 extends over a respective shoulder of the user, as shown in FIG. 1, and is coupled to and extends between a respective opposing end 24 of the first slat 16 and the set of second slats 18. The pair of third slats 20 is configured to transfer load from the first slat 16 to the set of second slats 18, thus helping to support the breasts.

The first slat 16 is S-shaped so that the first slat 16 is complementary to a curvature of the lower limit of the breasts of the user.

The set of second slats 18 comprises a perimeter slat 26 and a set of medial slats 28. Each medial slat 28 is coupled to and extends between the perimeter slat 26. The set of medial slats 28 comprises a horizontal slat 30 that is positioned substantially equally distant from an upper edge 32 and a lower edge 34 of the perimeter slat 26. The set of medial slats 28 also comprises a vertical slat 36 that is positioned substantially equally distant from opposing side edges 38 of the perimeter slat 26. The vertical slat 36 may extend past the perimeter slat 26 to a neckline 40 of the shirt 12.

The first slat 16, the second slats 18, and the third slats 20 comprise at least one of bamboo and steel. The shirt 12 comprises an inner layer 42 and an outer layer 44, as shown in FIG. 3. The first slat 16, the set of second slats 18, and the third slats 20 are positioned between the inner layer 42 and the outer layer 44.

Each of a pair of fourth slats 46 is coupled to a respective opposing side edge 38 proximate to the lower edge 34 of the perimeter slat 26 and extends into a front 48 of the shirt 12. The fourth slats 46 serve to tighten the abdomen of the user. The fourth slats 46 also comprise at least one of bamboo and steel and are positioned between the inner layer 42 and the outer layer 44.

In use, the shirt 12 is donned by the user positioning the first slat 16 to provide support and shaping to the breasts. The sleeves 14 provide shaping to the upper arms, and the set of second slats 18 provides support to the back of the user.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

I claim:

1. A shaping undergarment device comprising:

a shirt configured for donning by a user such that the shirt substantially covers a torso of the user, the shirt comprising an inner laver and an outer layer, the inner layer defining an inner surface of the shirt;

a first slat coupled to the inner layer of the shirt such that the first slat is configured to be positioned adjacent to a lower limit of breasts of the user, the first slat being S-shaped such that the first slat is complementary to and configured to extend across a curvature of the lower limit of both of the breasts of the user, the first slat being positioned between the inner layer and the outer layer wherein the inner layer abutting the first slat is configured to be in abutment with and extend across the curvature of the lower limit of both of the breasts of the user;

a set of second slats coupled to the inner surface of the shirt such that the set of second slats is configured to be positioned adjacent to a back of the user, wherein the set of second slats is configured for supporting the back of the user; and a pair of third slats coupled to the inner surface of the shirt such that each third slat is configured to be positioned extending over a respective shoulder of the user, each third slat being coupled to and extending between a respective opposing end of the first slat and the set of second slats wherein the pair of third slats is configured for transferring load from the first slat to the set of second slats.

2. The device of claim 1, further including the shirt being resiliently stretchable such that the shirt is configured to be form fitting.

3. The device of claim 2, further including the shirt comprising polyether-polyurea copolymer.

4. The device of claim 2, further including the shirt having short sleeves that are configured to cover upper arms of the user wherein the sleeves are configured for shaping the upper arms of the user.

5. The device of claim 1, further including the set of second slats comprising a perimeter slat and a set of medial slats.

6. The device of claim 5, further including the set of medial slats comprising:

a horizontal slat positioned substantially equally distant from an upper edge and a lower edge of the perimeter slat; and a vertical slat positioned substantially equally distant from opposing side edges of the perimeter slat, the horizontal slat being coupled to and extending between the opposing side edges of the perimeter slat, and the vertical slat being coupled to and extending between the upper edge and the lower edge of the perimeter slat.

7. The device of claim 6, further including the vertical slat extending past the perimeter slat to a neckline of the shirt.

8. The device of claim 6, further comprising the set of second slats and the third slats being positioned between the inner layer and the outer layer.

9. The device of claim 8, further including a pair of fourth slats, each fourth slat being coupled to a respective one of the opposing side edges of the perimeter slat proximate to the lower edge of the perimeter slat and extending into a front of the shirt.

10. The device of claim 9, further including the fourth slats comprising at least one of bamboo and steel.

11. The device of claim 9, further including the fourth slats being positioned between the inner layer and the outer layer.

12. The device of claim 1, further including the first slat, the set of second slats, and the third slats comprising at least one of bamboo and steel.

13. A shaping undergarment device comprising:

a shirt configured for donning by a user such that the shirt substantially covers a torso of the user, the shirt being resiliently stretchable such that the shirt is configured to be form fitting, the shirt comprising polyether-polyurea copolymer, the shirt comprising an inner layer and an outer layer, the inner layer defining an inner surface of the shirt, and the shirt having short sleeves that are configured to cover upper arms of the user wherein the sleeves are configured for shaping the upper arms of the user;

a first slat coupled to the inner layer of the shirt such that the first slat is configured to be positioned adjacent to a lower limit of breasts of the user, the first slat being S-shaped such that the first slat is complementary to and configured to extend across a curvature of the lower limit of both of the breasts of the user, the first slat comprising at least one of bamboo and steel, the first slat being positioned between the inner layer and the outer layer wherein the inner layer abutting the first slat is configured to be in abutment with and extend across the curvature of the lower limit of both of the breasts of the user;

a set of second slats coupled to the inner surface of the shirt such that the set of second slats is configured to be positioned adjacent to a back of the user, wherein the set of second slats is configured for supporting the back of the user, the second slats comprising at least one of bamboo and steel, the set of second slats comprising a perimeter slat and a set of medial slats, m the set of medial slats comprising a horizontal slat positioned substantially equally distant from an upper edge and a lower edge of the perimeter slat, the set of medial slats comprising a vertical slat positioned substantially equally distant from opposing side edges of the perimeter slat, the horizontal slat being coupled to and extending between the opposing side edges of the perimeter slat, the vertical slat being coupled to and extending between the upper edge and the lower edge of the perimeter slat, the vertical slat extending past the perimeter slat to a neckline of the shirt, the set of second slats being positioned between the inner layer and the outer layer;

a pair of third slats coupled to the inner surface of the shirt such that each third slat is configured to be positioned extending over a respective shoulder of the user, each third slat being coupled to and extending between a respective opposing end of the first slat and the set of second slats wherein the pair of third slats is configured for transferring load from the first slat to the set of second slats, the third slats comprising at least one of bamboo and steel, the third slats being positioned between the inner layer and the outer layer; and a pair of fourth slats, each fourth slat being coupled to a respective one of the opposing side edges of the perimeter slat proximate to the lower edge of the perimeter slat and extending into a front of the shirt, the fourth slats comprising at least one of bamboo and steel, the fourth slats being positioned between the inner layer and the outer layer.

* * * * *